US011426889B2

(12) United States Patent
Jo et al.

(10) Patent No.: US 11,426,889 B2
(45) Date of Patent: Aug. 30, 2022

(54) RAZOR CARTRIDGE AND MANUFACTURING METHOD THEREOF

(71) Applicant: DORCO CO., LTD., Seoul (KR)

(72) Inventors: Min Jy Jo, Yongin-si (KR); Do Yun Kong, Yongin-si (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 17/103,607

(22) Filed: Nov. 24, 2020

(65) Prior Publication Data

US 2021/0154870 A1 May 27, 2021

(30) Foreign Application Priority Data

Nov. 27, 2019 (KR) ..... 10-2019-0153911

(51) Int. Cl.
*B26B 21/40* (2006.01)

(52) U.S. Cl.
CPC ..... *B26B 21/4012* (2013.01); *B26B 21/4068* (2013.01)

(58) Field of Classification Search
None
See application file for complete search history.

(56) References Cited

U.S. PATENT DOCUMENTS 5,056,222 A * 10/1991 Miller ..... B26B 21/443 30/77
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,044,542 A * 4/2000 Apprille, Jr. ..... B26B 21/4068 29/525.05
6,052,903 A 4/2000 Metcalf et al.
6,161,287 A * 12/2000 Swanson ..... B26B 21/443 30/50
6,185,822 B1 2/2001 Tseng et al.
6,212,777 B1 4/2001 Gilder et al.
6,442,839 B1 9/2002 Tseng et al.
6,516,518 B1 2/2003 Garraway et al.
6,612,040 B2 9/2003 Gilder
(Continued)

FOREIGN PATENT DOCUMENTS

JP 2001-518333 10/2001
KR 101876232 7/2018
(Continued)

OTHER PUBLICATIONS

European Patent Office Application Serial No. 20210057.4, Search Report dated Apr. 20, 2021, 9 pages.

*Primary Examiner* — Hwei-Siu G Payer
(74) *Attorney, Agent, or Firm* — Lee, Hong, Degerman, Kang & Waimey PC

(57) ABSTRACT

A razor cartridge and a method of manufacturing the same are disclosed. The present disclosure in at least one embodiment provides a razor cartridge including one or more shaving blades each having a cutting edge, a blade housing configured to accommodate the one or more shaving blades in a longitudinal direction of the blade housing, and one or more clips each configured to fix the one or more shaving blades to the blade housing and having a shape of a closed loop.

15 Claims, 8 Drawing Sheets

(56) References Cited

U.S. PATENT DOCUMENTS

| | | | | |
|---|---|---|---|---|
| 6,684,513 | B1 | 2/2004 | Clipstone et al. | |
| 10,052,775 | B2 * | 8/2018 | Davos | B26B 21/4068 |
| 2011/0289779 | A1 | 12/2011 | Volodin et al. | |
| 2018/0311847 | A1 * | 11/2018 | Ntavos | B26B 21/4068 |
| 2019/0061184 | A1 * | 2/2019 | Lin | B26B 21/4031 |
| 2019/0202076 | A1 | 7/2019 | Park et al. | |
| 2021/0154870 | A1 * | 5/2021 | Jo | B26B 21/4068 |

FOREIGN PATENT DOCUMENTS

| | | |
|---|---|---|
| WO | 9916591 | 4/1999 |
| WO | 1999016591 | 4/1999 |
| WO | 9955499 | 11/1999 |

* cited by examiner

RAZOR CARTRIDGE AND MANUFACTURING METHOD THEREOF

CROSS-REFERENCE TO RELATED APPLICATION

Pursuant to 35 U.S.C. § 119(a), this application claims the benefit of earlier filing date and right of priority to Korean Patent Application No. 10-2019-0153911, filed on Nov. 27, 2019, the contents of which are all hereby incorporated by reference herein in its entirety.

TECHNICAL FIELD

The present disclosure in some embodiments relates to a razor cartridge and a method of manufacturing the same.

BACKGROUND

The statements in this section merely provide background information related to the present disclosure and do not necessarily constitute prior art.

A razor cartridge includes a shaving blade having a cutting edge, a blade housing for accommodating the shaving blade, and a clip for holding the shaving blade in the blade housing.

In general, the clip has an elongated strip shape. In particular, the clip includes two legs formed on both sides thereof and a blade retaining portion disposed in the middle thereof.

With the blade support facing at least a portion of the shaving blade, the two legs surround the sides of the blade housing (i.e., out-board clip fastening method), or the two legs pass through the blade housing (i.e., in-board clip fastening method), or one of the two legs wraps around one side of the blade housing and the other passes through the blade housing (i.e., rear-wrap clip fastening method), so that the clip may be fixed to the blade housing. However, the conventional strip-shaped clip has several deficiencies.

For example, the conventional strip-shaped clip requires a process of bending an end of a leg that surrounds one side of the blade housing or passes through the blade housing.

Further, arranging at least one leg of the clip to pass through the blade housing requires a process of inserting and penetrating the end of the leg into a through-hole of the blade housing. In other words, the conventional strip-shaped clip has the very cumbersomeness of fixing it to the blade housing.

On the other hand, the conventional strip-shaped clip is generally made of a material that is easy to process such as bending or cutting. Accordingly, the conventional strip-shaped clip has a weakness in that it is easy for a user to arbitrarily open the end of the clip, and it is easily damaged by an external force or an external impact.

In this case, the shaving blade held by the clip is susceptible to be separated from the blade housing, thereby threatening the user's safety shaving.

SUMMARY

According to at least one embodiment, the present disclosure provides a razor cartridge including at least one or more shaving blades each having a cutting edge, a blade housing configured to accommodate the one or more shaving blades in a longitudinal direction of the blade housing, and at least one or more clips each configured to fix the one or more shaving blades to the blade housing and having a shape of a closed loop.

DETAILED DESCRIPTION

Figure 1:
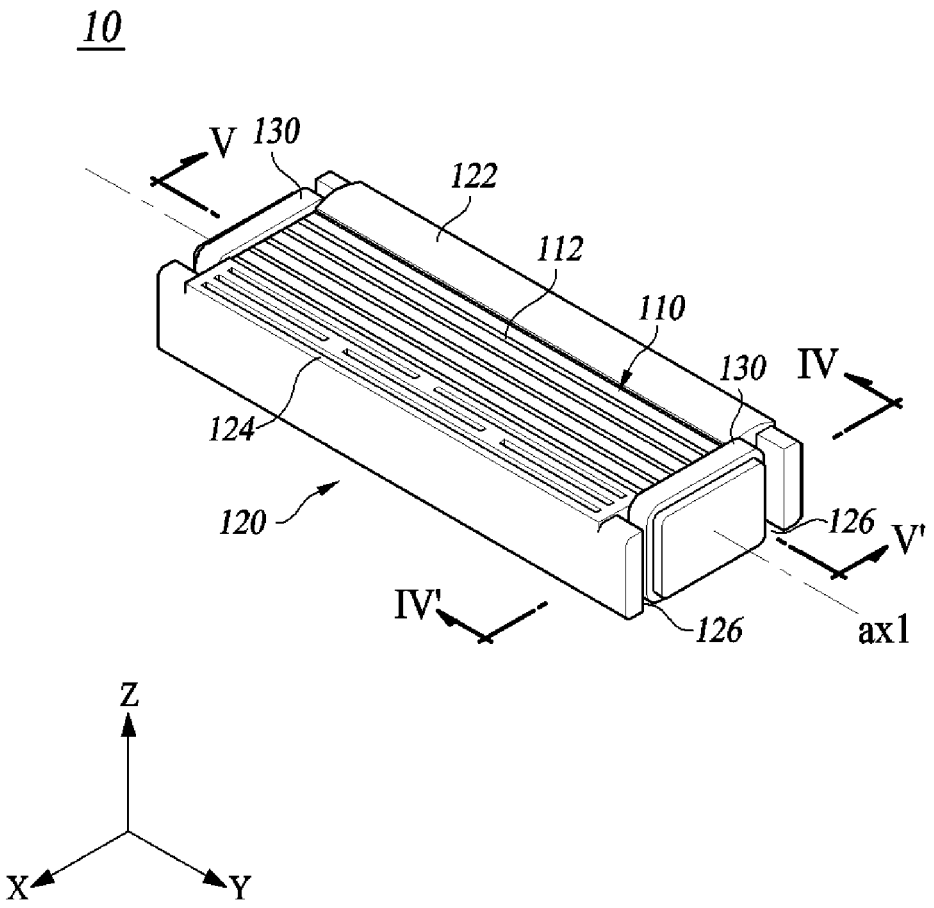
FIG. 1 is a perspective view of a razor cartridge according to at least one embodiment of the present disclosure.

The present disclosure in at least one embodiment seeks to provide a razor cartridge including a clip that can be firmly fixed to a blade housing resulting in an improved razor cartridge and an improved assembly process.

Some exemplary embodiments of the present disclosure are described below with reference to the accompanying drawings. In the following description, like reference numerals preferably designate like elements, although the elements are shown in different drawings. Further, in the following description of some embodiments, a detailed description of known functions and configurations incorporated herein will be omitted for the purpose of clarity and for brevity.

Additionally, alphanumeric code such as first, second, i), ii), (a), (b), etc., in describing components are used solely for the purpose of differentiating one component from the other but not to imply or suggest the substances, the order or sequence of the components. Throughout this specification, when a part "includes" or "comprises" a component, the part is meant to further include other components, not excluding thereof unless there is a particular description contrary thereto.

FIG. 1 is a perspective view of a razor cartridge 10 according to at least one embodiment of the present disclosure.

Figure 2:
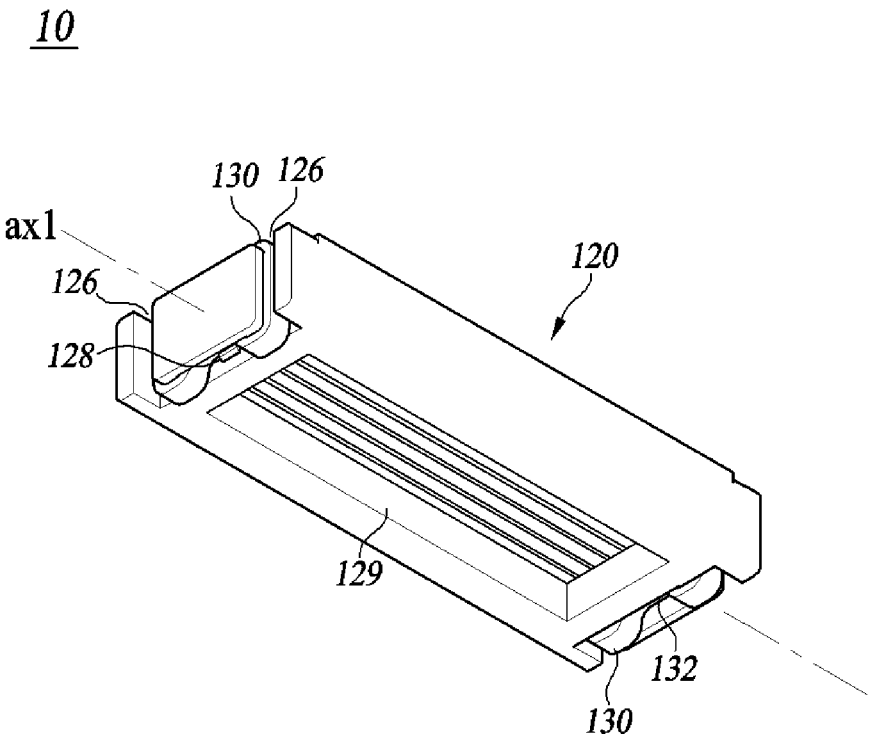
FIG. 2 is a rear perspective view of the razor cartridge according to at least one embodiment of the present disclosure.

FIG. 2 is a rear perspective view of the razor cartridge 10 according to at least one embodiment of the present disclosure.

As shown in FIGS. 1 and 2, the razor cartridge 10 may include a blade housing 120, one or more shaving blades 110, and one or more clips 130.

The blade housing 120 may accommodate at least one or more shaving blades 110 each having a cutting edge 112 arranged along a longitudinal direction of the blade housing. Here, the longitudinal direction refers to the width direction of the blade housing 120. For example, in FIG. 1, the longitudinal direction is a direction parallel to the Y-axis.

The one or more shaving blades 110, when accommodated on one side of the blade housing 120 may be held by one or more clips 130.

The blade housing 120 may include a cap 122, a guard 124, and side slits 126.

The cap 122 may be located rearwardly of the shaving blades 110, and specifically, it may be disposed on the top side of the blade housing 120. Here, the top side of the blade housing is defined as the side of the blade housing where the cutting edges of the shaving blades 110 are exposed.

Here, the forward and rearward directions of the shaving blade 110 are defined based on the shaving direction of the razor cartridge 10. A shaving direction of the razor cartridge is defined as the direction in which the razor cartridge is moved by a user when shaving in order to cut hair using the shaving blades 110. Accordingly, in FIG. 1, the forward and rearward directions of the shaving blades 110 are, respectively, the positive X-axis direction and the negative X-axis direction with respect to the shaving blades 110, and the shaving direction is the positive X-axis direction.

The guard 124 may be located in front of the shaving blades 110 at the top side of the blade housing 120.

The guard 124, when shaving, can stretch the skin in the shaving direction before the cutting of the body hair by the shaving blade 110.

This allows the user's body hair to be erected in a direction perpendicular to the user's skin surface, whereby the shaving blade 110 can more easily cut the body hair.

Each side slit 126 may be outwardly open at the lateral side end of the blade housing 120, and at least a portion of the clip 130 may be received in the side slit 126.

In FIGS. 1 and 2, two side slits 126 are formed on one lateral side end of the blade housing 120, and the clip 130 is shown to be at least partially received in each side slit, although the present disclosure is not limited thereto.

For example, in some embodiments one side slit 126 may be formed at each lateral side end of the blade housing 120, and other embodiments may not include the side slits 126. A detailed description of examples will be described by referring to FIGS. 8 to 10.

In the embodiment shown in FIGS. 1 and 2, two side slits 126 may be disposed further forward and further rearward, respectively, of the one or more shaving blades 110 on each lateral side end of the blade housing 120, respectively.

This allows the region of the clip 130 disposed on the top side of the blade housing 120 between the two side slits 126 to support at least a portion or some of the shaving blades 110 in their entirety, received in the blade housing 120.

However, the present disclosure is not limited to the particular configuration, as the position of the side slit 126 may vary depending on the number of side slits 126 provided in the blade housing 120 or the fastening method of the clip 130.

The blade housing 120 may further include a rinsing hole 129. The rinsing hole 129 may be an opening formed at the bottom side of the blade housing 120, as shown in FIG. 2. The user can remove foreign matter accumulated between the one or more shaving blades 110 by flowing water through the rinsing hole 129.

Here, the bottom side of the blade housing 120 refers to a side opposite the top side of the blade housing 120.

The clip 130 is configured to fix the one or more shaving blades 110 to the blade housing 120. This allows the clip 130 to prevent the one or more shaving blades 110 from being separated from the blade housing 120.

The clip 130 according to at least one embodiment of the present disclosure features a shape of a closed loop. Accordingly, the clip 130 may include no perceptible ends or it may be impossible or very difficult to separate any ends thereof.

The clip 130 may assume a closed-loop shape to surround at least some of the entire blade housing 120 about a first axis ax1 parallel to the longitudinal direction. First axis ax1 may pass through the blade housing 120.

In FIG. 1, the clip 130 is shown to have a rectangular shape, although the present disclosure is not limited thereto.

For example, the clip 130 may have a circular shape or other polygonal shape.

The clip 130 according to at least one embodiment of the present disclosure, unlike a conventional clip that is fixed on the blade housing by bending both ends, obviates the need for a bending step in the fixing process or the step of inserting a leg in a through-hole of the blade housing, which is advantageous in the manufacturing process.

Additionally, the clip 130 according to at least one embodiment is advantageous in terms of safety since it is difficult to be released once fixed to the blade housing 120 to prevent the shaving blade 110 from being detached or otherwise failing.

Since the clip 130 according to at least one embodiment has a closed-loop shape, it may be fixed on the blade housing 120 through a method different from that of a conventional clip. A detailed description related thereto is presented in connection with FIG. 3.

Figure 3:
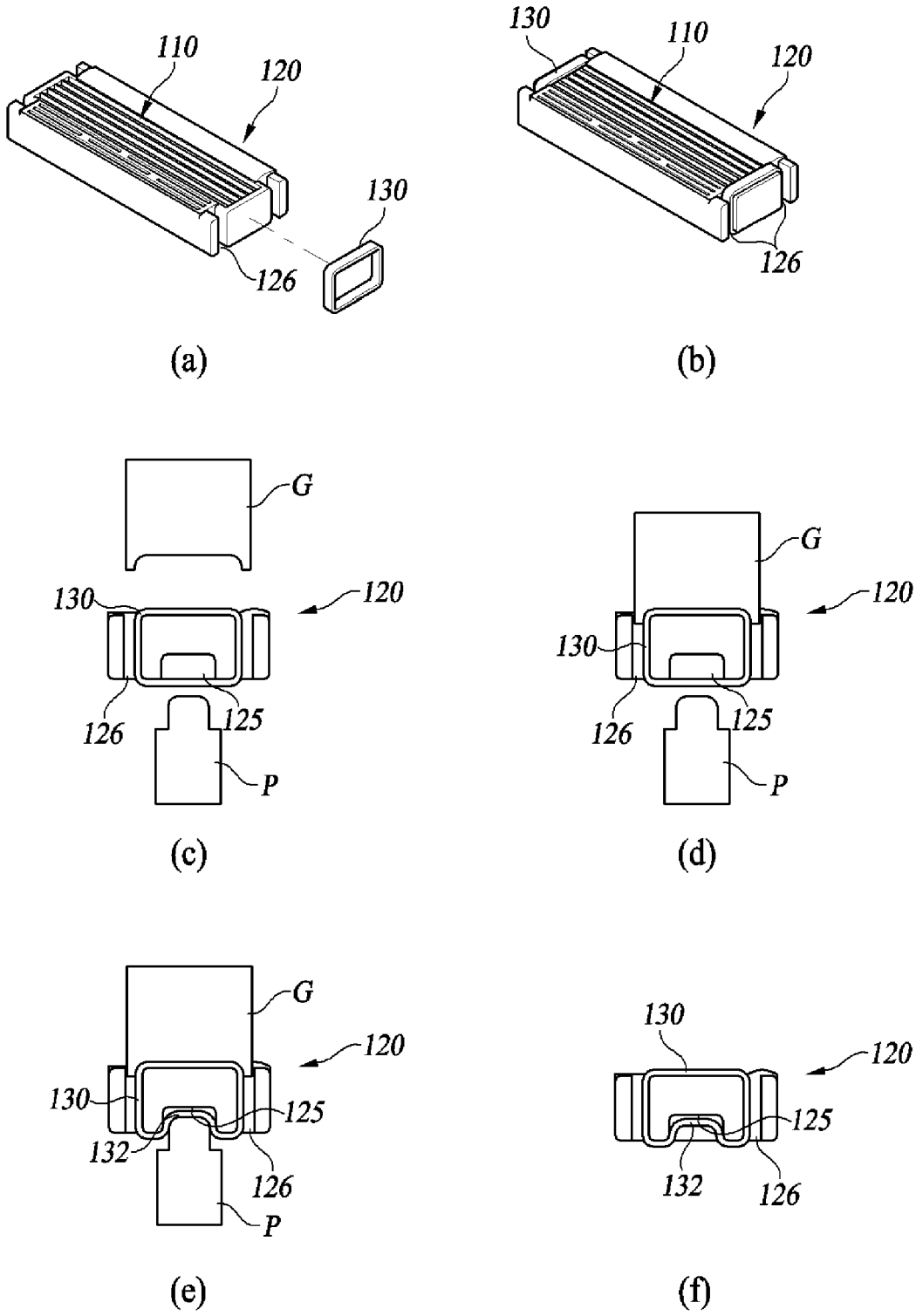
FIG. 3 illustrates a process in which a clip is fixed to a blade housing according to at least one embodiment of the present disclosure.

FIG. 3 illustrates a process in which the clip 130 is fixed to the blade housing 120 according to at least one embodiment of the present disclosure.

As shown in FIG. 3 at (a) and (b), at least one or more shaving blades 110 each having a cutting edge 112 may be received in the blade housing 120 in the longitudinal direction of the blade housing.

Thereafter, the clip 130 may be positioned adjacent to the circumference of at least some of the blade housing 120 such that the clip 130 faces at least some of the one or more shaving blades 110.

In this case, at least some of the clip 130 may be inserted into the side slits 126.

As shown in FIG. 3 at (c) and (d), the clip 130 is brought to close contact with the blade housing 120, so that the clip 130 may be held in position.

Specifically, the region of the clip 130 facing the top side of the blade housing 120 may be pressed by a fixing guide G to be in close contact with the top side of the blade housing 120.

As shown in FIG. 3 at (e) and (f), by deforming the clip 130, the one or more shaving blades 110 may be secured or fixed to the blade housing 120.

Specifically, with the clip 130 held by the fixing guide G at the top side of the blade housing, the region of the clip 130 adjacent to the bottom side of the blade housing 120 may undergo a press process performed by using a deforming device P. The deforming device may be a punching device, although the present disclosure is not limited thereto.

Upon completion of the press process, the region of the clip 130 may be formed with a concave region 132. The concave region 132 is deformed, and its shape can be maintained even with the deforming device P removed after the pressing process.

Meanwhile, the blade housing 120 may include a recess 125 formed on an area of the blade housing 120 surrounded by each clip 130.

The recess 125 may guide the region of the clip 130 in which the press process is performed, which allows the deformation of the clip 130 to be made more easily.

For example, the press process using the deforming device P may be performed for one region of the clip 130 facing the recess 125, and the concave region 132 may be so formed as to be concave toward the recess 125.

In this case, the deforming device P may have a shape corresponding to the recess 125, although the present disclosure is not limited thereto.

In some embodiments, the recess 125 of the blade housing 120 may include various configurations. For example, non-recessed portions 1252 may be formed on both sides of the recess 125 having depressed portion 1254, as shown for example in FIGS. 4A, 4B, 4C.

The blade housing may include one or more recesses, and each recess may include one or more recessed portions 1254. As discussed further below with respect to FIGS. 4A-F, in some embodiments, a recess may include multiple recessed portions having different depths with respect to an adjacent non-recessed portion. In some embodiments, multiple recesses may be surrounded by multiple non-recessed portions. In some embodiments, the non-recessed portions may also have different heights with respect to corresponding adjacent recesses. At least some of the one region of the clip 130 may contact at least one of the non-recessed portions 1252 and the depressed portion 1254. This prevents the movement or separation of the clip 130 which is thus fixed on the blade housing 120 more firmly.

In FIG. 3, the deforming device P is shown to deform the area of the clip 130 adjacent to the bottom side of the blade housing 120, although the present disclosure is not limited thereto.

According to embodiments, the clip of the present disclosure may be deformed through the deforming device P with respect to the region of the clip adjacent to the top side or a lateral side of the blade housing 120.

FIGS. 4A to 4F illustrate various embodiments of the razor cartridge 10 and clip 130 according to the present disclosure, as viewed in a cross-section taken in the direction IV-IV' of FIG. 1.

Specifically, in FIGS. 4A to 4F, various embodiments of the recess 125 of the blade housing 120 and the concave region 132 of the clip 130.

Figure 4A:
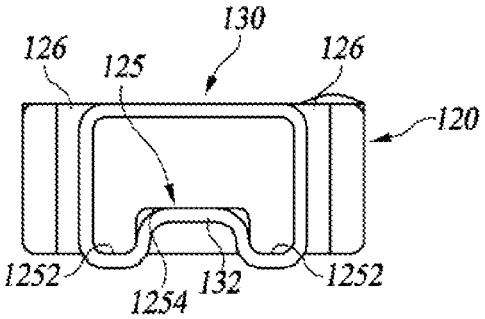
FIGS. 4A to 4F illustrate the razor cartridge 10 according to some embodiments of the present disclosure, as viewed in a cross-section taken in the direction IV-IV' of FIG. 1.

As shown in FIG. 4A, a concave region 132 of the clip 130 may generally conform to a recess 125 of the blade housing 120.

In this case, a region of the clip 130 in which the concave region 132 is formed may contact both the non-recessed portions 1252 and the depressed portion 1254 of the blade housing 120.

Figure 4B:
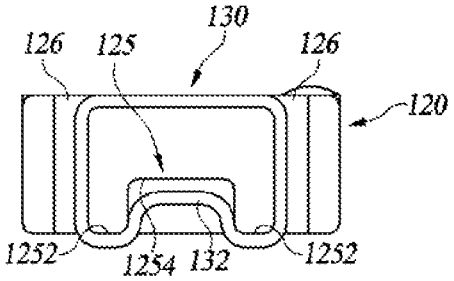

As shown in FIG. 4B, a region of the clip 130 in which the concave region 132 is formed may contact the non-recessed portions 1252 but not the depressed portion 1254.

Figure 4C:
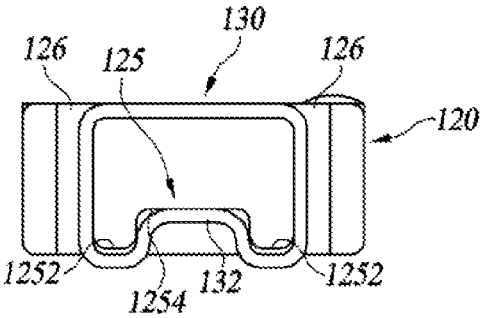

As shown in FIG. 4C, a region of the clip 130 in which the concave region 132 is formed may contact the depressed portion 1254 but not the non-recessed 1252.

Figure 4D:
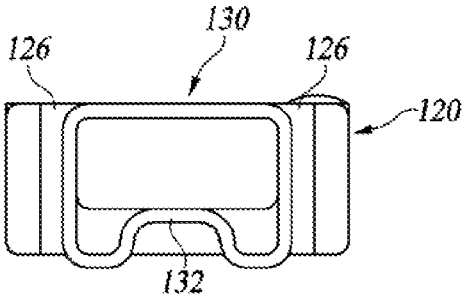

As shown in FIG. 4D, a recess 125 may not be provided on the blade housing 120. In particular, a region of the blade housing 120 facing the concave region 132 may be formed without involving an uneven structure.

In this case, the tip portion of the concave region 132 may contact the corresponding region of the blade housing 120.

Figure 4E:
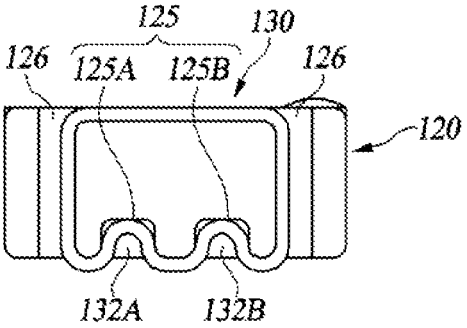

As shown in FIG. 4E, the recess 125 may include a first recess 125A and a second recess 125B spaced apart from the first recess 125A.

One region of the clip 130 may include a first concave region 132A and a second concave region 132B.

The first concave region 132A may be formed to be concave toward the first recess 125A, and the second concave region 132B may be formed to be concave toward the second recess 125B.

In this case, the first concave region 132A and the second concave region 132B may not overlap each other.

Between the first concave region 132A and the second concave region 132B, one of the two may be formed first and the other may be formed subsequently. In particular, the pressing process may be sequentially performed a plurality of times.

This can prevent the issue that the clip 130 is broken or damaged by giving a large amount of deformation or impact to the clip 130 at a time.

However, the present disclosure is not limited thereto, and the first concave region 132A and the second concave region 132B may be formed at once by the deforming device P configured to have two protrusion portions spaced apart from each other.

Figure 4F:
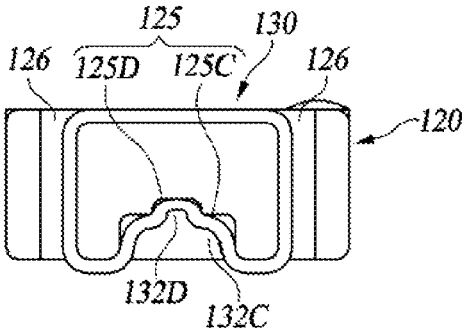

As shown in FIG. 4F, in place of the recess 125, the clip 130 may include a third recess 125C and a fourth recess 125D formed from the third recess 125C.

The clip 130 may have one region including a third concave region 132C and a fourth concave region 132D formed on the third concave region 132C.

The third concave region 132C may be formed to be concave toward the third recess 125C, and the fourth concave region 132D may be formed to be concave toward the fourth recess 125D.

In this case, the fourth concave region 132D may overlap at least some of the third concave region 132C.

The third concave region 132C may be first formed by using a relatively wide first deforming device (not shown), and the fourth concave region 132D may be subsequently formed by using a relatively narrow second deforming device (not shown). In other words, the pressing process may be sequentially performed a plurality of times.

This can prevent the issue that the clip 130 is broken or damaged by giving a large amount of deformation or impact to the clip 130 at a time.

However, the present disclosure is not limited thereto, and the third concave region 132C and the fourth concave region 132D may also be formed at once by using the deforming device configured to have a multistage shape.

Figure 5:
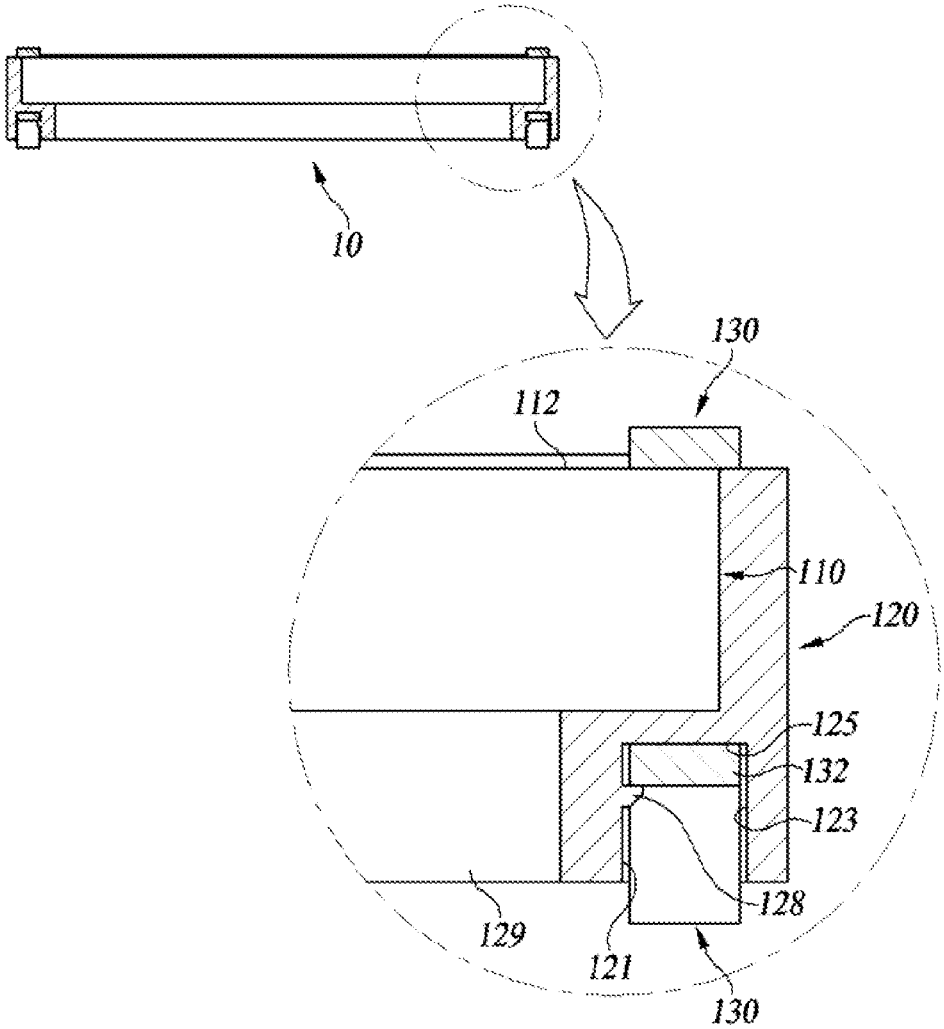
FIG. 5 is a longitudinal cross-sectional view of the razor cartridge according to at least one embodiment of the present disclosure, taken in the direction V-V' of FIG. 1.

FIG. 5 is a longitudinal cross-sectional view of the razor cartridge 10 according to at least one embodiment of the present disclosure, taken in the direction V-V of FIG. 1, including an enlarged view of an end portion of the cross-sectional view for clarity and discussion purposes.

As shown in FIG. 5, the blade housing 120 may include at least one protrusion portion 128 protruding from one side of the blade housing 120 adjacent to the recess 125.

The at least one protrusion portion 128 may face and secure at least some of the outer peripheral surface of the concave region 132. Therefore, the protrusion portion 128 can prevent the concave region 132 from returning to its pre-deformed shape after the pressing process.

The protrusion portion 128 facing the concave region 132 may have a securing surface that is parallel to the longitudinal direction, and another surface of the protrusion portion 128 may be inclined relative to the securing surface of the protrusion portion 128.

Therefore, at least some of the protrusion portion 128 may have the securing surface and the other inclined surface converge toward each other at the free end of the protrusion portion 128.

Accordingly, during the pressing process, the inclination formed on the inclined surface of the protrusion portion 128 enables the clip 130 to be pressed into the recess 125 past the inclined portion to be secured by the securing surface. Conversely, after the pressing process, the flatness of the securing surface of the protrusion portion 128 stops the clip 130 from being detached.

However, the present disclosure is not limited thereto, and the protrusion portion 128 may have both one surface and the other surface to be parallel with the longitudinal direction.

The protrusion portion 128 may be in contact with at least some of the outer peripheral surface of the concave region 132, but they may be spaced apart from each other.

In FIG. 5, the protrusion portion 128 is shown to protrude from an inner wall 121 of the blade housing 120, although the present disclosure is not limited thereto.

For example, the protrusion portion 128 may protrude from an outer wall 123 of the blade housing 120, or two of the protrusion portion 128 may protrude from both the inner wall 121 and the outer wall 123.

Figure 6:
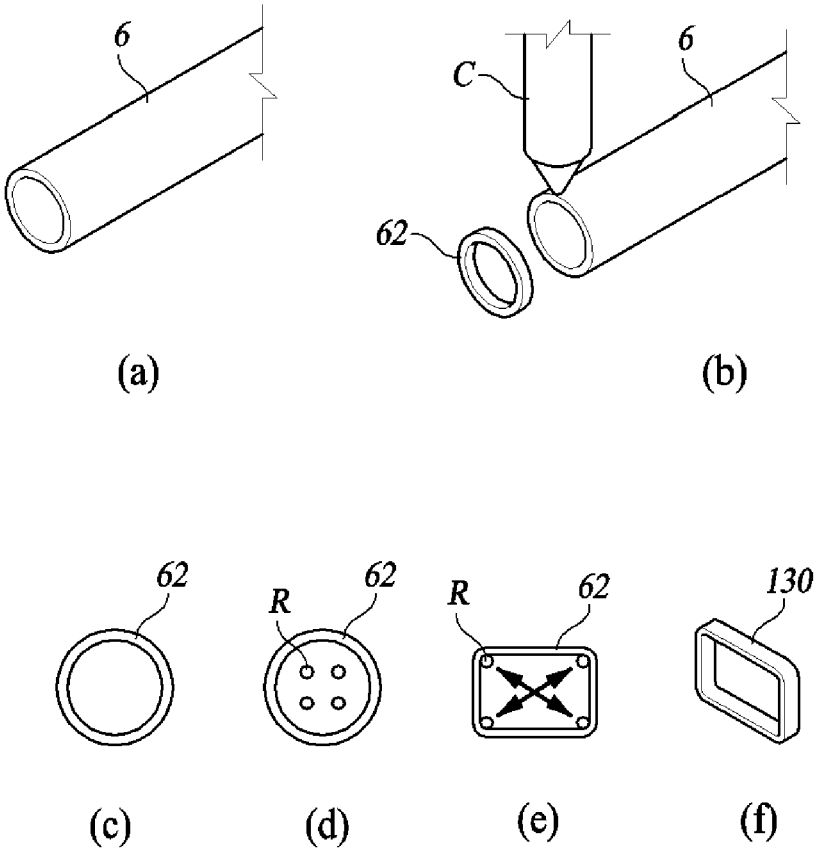
FIG. 6 illustrates a process of manufacturing a clip according to at least one embodiment of the present disclosure.

FIG. 6 illustrates a process of manufacturing the clip 130 according to at least one embodiment of the present disclosure.

As shown in FIG. 6 at (a) and (b), a hollow pipe 6 may be cut perpendicular to the longitudinal direction of the pipe 6 by using a cutting device C. A pipe segment 62 formed by cutting the pipe 6 may have the same width as the clip 130.

The cutting device C may be a laser cutting device, although the present disclosure is not limited thereto.

As shown in FIG. 6 at (c) and (d), a plurality of rods R may be inserted into the hollow of the pipe segment 62, and the inserted plurality of rods R may draw the pipe segment 62 outwardly.

By outwardly drawing the pipe segment 62, the plurality of rods R may shape the same into the clip 130.

As shown in FIG. 6 at (e), the plurality of rods R after the outwardly drawing of the pipe segment 62 may be removed therefrom. This completes the clip 130 having the shape of a closed loop.

The manufacturing method of the clip 130 shown in FIG. 6 is only one of many different manufacturing methods of the clip according to the present disclosure. The present disclosure also envisions other methods of manufacturing the clip than the method illustrated in FIG. 6.

Accordingly, the formation of the closed loop of the clip according to the present disclosure may be made even before being fixed to the blade housing, as with the clip 130 according to at least one embodiment as illustrated in FIGS. 1 to 6, although the present disclosure is not limited thereto.

For example, the formation of the closed loop of the clip according to the present disclosure may be performed after the clip is fixed to the blade housing.

Specifically, the clip according to the present disclosure may have a strip shape surrounding at least some of the blade housing. In this case, for the clip to have a closed-loop shape, both ends of the strip-shaped clip may be connected so that they are inseparable or difficult to separate.

Figure 7:
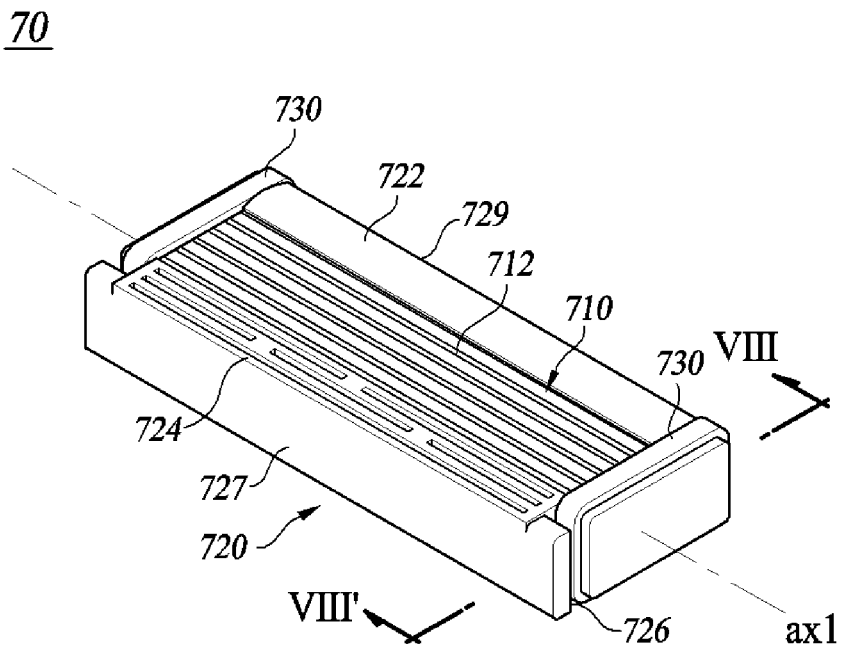
FIG. 7 is a perspective view of a razor cartridge according to another embodiment of the present disclosure.
Figure 8:
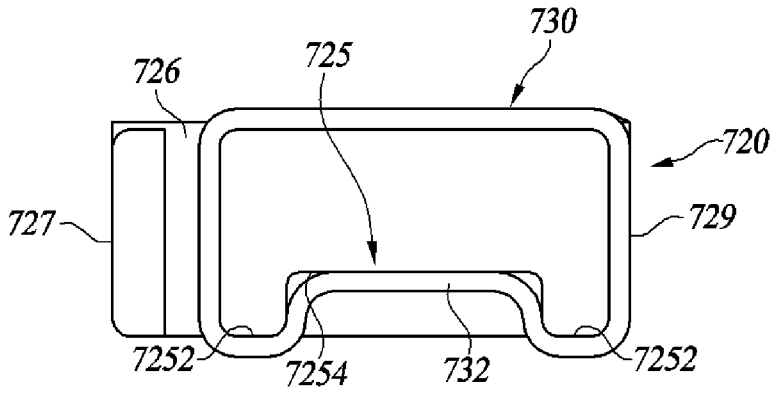
FIG. 8 is a cross-sectional view of the razor cartridge according to another exemplary embodiment of the present disclosure, taken in the direction VIII-VIII' of FIG. 7.

Another embodiment of the present disclosure as illustrated in FIGS. 7 to 8 to be described is different from the embodiments of the present disclosure illustrated in FIGS. 1 to 6 in that one lateral side end of the blade housing has a single slit on each side. The following focuses on the differentiated features according to another embodiment of the present disclosure, omitting a repetitive description of a configuration substantially the same as that of the aforementioned embodiments.

FIG. 7 is a perspective view of a razor cartridge 70 according to another embodiment of the present disclosure.

FIG. 8 is a cross-sectional view of the razor cartridge 70 according to another embodiment of the present disclosure, taken in the direction VIII-VIII' of FIG. 7.

As shown in FIGS. 7 and 8, a blade housing 720 may be provided with single side slits 726 each outwardly open at each lateral side end of the blade housing 720.

A clip 730 having a closed-loop shape may be at least partially received in the single side slit 726, and then the clip 730 has one area received in the side slit 726 and the other area surrounding a rear side 729 of the blade housing 720.

Here, the rear side 729 of the blade housing 720 refers to a surface disposed toward the rear of the one or more shaving blades 710. Conversely, the blade housing 720 has a front side 727 which refers to a surface disposed toward the front of the one or more shaving blades.

As shown in FIGS. 7 and 8, the single side slit 726 may be disposed further forward of the one or more shaving blades 710, and some of the clip 730 surrounds the rear side 729, although the present disclosure is not limited thereto.

An example alternate configuration may have the single side slit 726 disposed rearwardly of the one or more shaving blades 710 and some of the clip 730 surrounding the front surface 727.

Figure 9:
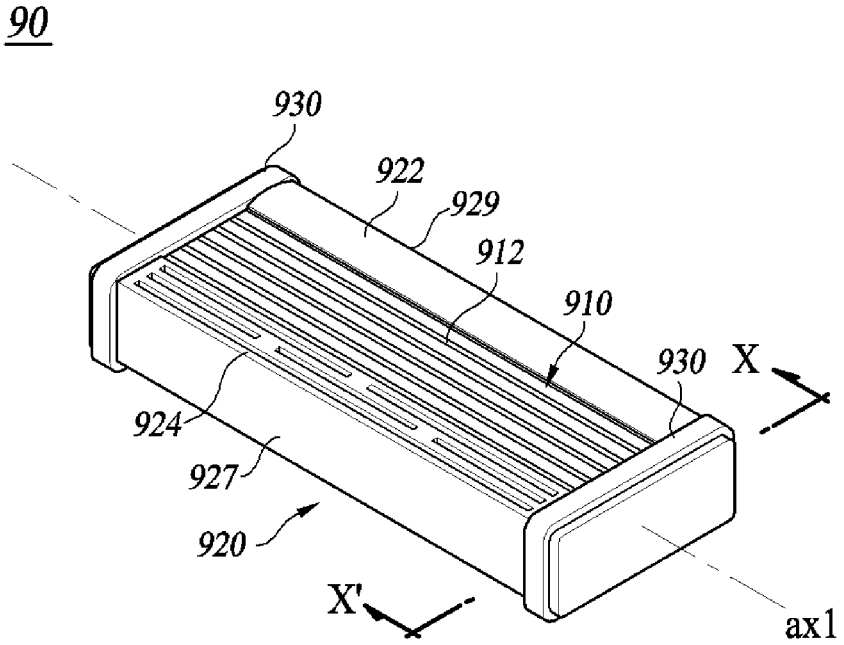
FIG. 9 is a perspective view of a razor cartridge according to yet another embodiment of the present disclosure.
Figure 10:
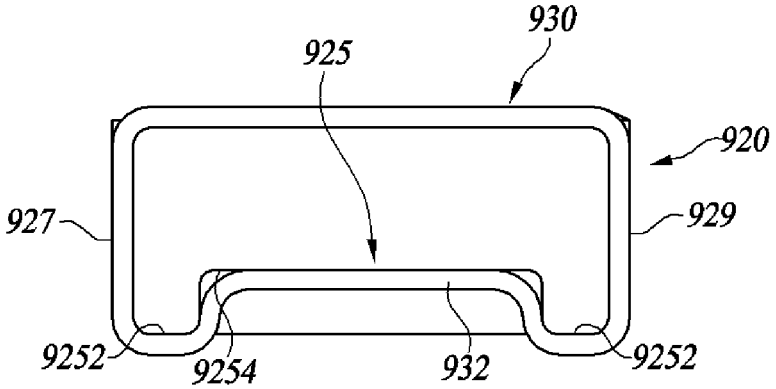
FIG. 10 is a cross-sectional view of the razor cartridge according to yet another embodiment of the present disclosure, taken in the direction X-X' of FIG. 9.

Yet another embodiment of the present disclosure as illustrated in FIGS. 9 to 10 to be described differs from the aforementioned embodiments of the present disclosure illustrated in FIGS. 1 to 6 in that the blade housing has no side slit. The following focuses on the differentiated features according to yet another embodiment of the present disclosure, omitting a repetitive description of a configuration substantially the same as that of the aforementioned embodiments.

FIG. 9 is a perspective view of a razor cartridge 90 according to yet another embodiment of the present disclosure.

FIG. 10 is a cross-sectional view of the razor cartridge 90 according to another embodiment of the present disclosure, taken in the direction X-X' of FIG. 9.

As shown in FIGS. 9 and 10, the razor cartridge 90 may have a blade housing 920 that includes no side slit.

In this case, a clip 930 having a closed-loop shape may be provided at least partially surrounding a front side 927 of the blade housing 920, whereby the clip 930 has one area surrounding the front side 927 and the other area surrounding a rear side 929 of the blade housing 920.

As described above, according to some embodiments, the razor cartridge can improve the productivity of the razor cartridge by fixing the clip to the blade housing through a relatively simple process.

Additionally, the razor cartridge according to some embodiments can provide the user with a safe shaving experience by making the clip difficult to be released once fixed to the blade housing.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor cartridge, comprising:

one or more shaving blades each having a cutting edge;

a blade housing configured to accommodate the one or more shaving blades in a longitudinal direction of the blade housing; and one or more clips each configured to fix the one or more shaving blades to the blade housing and having a shape of a closed loop, wherein the blade housing comprises:

a top side which is a side of the blade housing where the cutting edge is exposed;

a bottom side which is a side opposite the top side; and a recess formed at the bottom side of the blade housing and surrounded by the one or more clips, and wherein the one or more clips comprise a concave region formed toward the recess.

2. The razor cartridge of claim 1, wherein a clip of the one or more clips is configured to surround at least a portion of the blade housing about a first axis parallel to the longitudinal direction.

3. The razor cartridge of claim 1, further comprising non-recessed portions formed on both sides of the recess, and wherein at least a portion of the concave region is in contact with at least one of the non-recessed portions or the recess.

4. The razor cartridge of claim 1, wherein the blade housing further comprises at least one protrusion portion protruding from one side of the blade housing adjacent to the recess, and wherein the at least one protruding portion is configured to secure an outer peripheral surface of the concave region of the clip.

5. The razor cartridge of claim 4, wherein the protrusion portion comprises a securing surface that is parallel to the longitudinal direction and an inclined surface that inclines from the one side of the blade housing relative to the securing surface of the protrusion portion, such that the securing surface and the inclined surface converge toward each other at a free end of the protrusion portion.

6. The razor cartridge of claim 1, wherein the recess is one of a plurality of recesses of the blade housing, the plurality of recesses comprising:

a first recess and a second recess spaced apart from the first recess, and wherein the concave region is one of a plurality of concave regions, the plurality of concave regions comprising:

a first concave region formed toward the first recess and a second concave region formed toward the second recess.

7. The razor cartridge of claim 2, wherein the concave region is formed toward the recess to be at least partially in contact with the recess.

8. The razor cartridge of claim 2, wherein the one or more shaving blades is fixed to the blade housing by the clip deformed to correspond to a shape of the blade housing.

9. The razor cartridge of claim 2, wherein the blade housing comprises:

a side slit outwardly open at a lateral side end of the blade housing and configured to receive at least a portion of the clip.

10. The razor cartridge of claim 9, wherein the side slit is disposed further forward of the one or more shaving blades.

11. The razor cartridge of claim 9, wherein the side slit is disposed further rearward of the one or more shaving blades.

12. A manufacturing method of a razor cartridge, comprising:

positioning at least one or more shaving blades each having a cutting edge in a blade housing along a longitudinal direction of the blade housing;

positioning a clip having a shape of a closed loop around at least a portion of the blade housing such that the clip faces at least a portion of the one or more shaving blades positioned in the blade housing; and concavely deforming a region of the clip toward a recess to surround the recess to fix the one or more shaving blades to the blade housing, wherein the blade housing comprises:

a top side which is a side of the blade housing where the cutting edge is exposed; and a bottom side which is a side opposite the top side, and wherein the recess is formed at the bottom side of the blade housing.

13. The manufacturing method of claim 12, wherein the deforming of the clip comprises:

performing a press process on the clip.

14. The manufacturing method of claim 13, wherein the press process comprises securing the clip in position against the blade housing prior to pressing.

15. The manufacturing method of claim 12, wherein the positioning the clip comprises:

inserting at least a portion of the clip into a side slit outwardly open at a lateral side end of the blade housing.

* * * * *